US012247815B2

(12) United States Patent
Smith et al.

(10) Patent No.: US 12,247,815 B2
(45) Date of Patent: Mar. 11, 2025

(54) ADJUSTABLE CARRIER DEVICE

(71) Applicant: HSG, LLC, Swansboro, NC (US)

(72) Inventors: Darrell Keith Smith, Swansboro, NC (US); Daniel Logan Chaney, Morehead City, NC (US)

(73) Assignee: HSG, LLC, Swansboro, NC (US)

( * ) Notice: Subject to any disclaimer, the term of this patent is extended or adjusted under 35 U.S.C. 154(b) by 886 days.

(21) Appl. No.: 17/098,018

(22) Filed: Nov. 13, 2020

(65) Prior Publication Data

US 2022/0155047 A1 May 19, 2022

(51) Int. Cl.
*F42B 39/02* (2006.01)

(52) U.S. Cl.
CPC ..... *F42B 39/02* (2013.01)

(58) Field of Classification Search
CPC ..... B65D 33/28; B65D 33/165; B65D 45/26; B65D 45/16; B65D 65/08; B65D 67/02; B65D 5/3692; B65D 5/4283; B65D 5/2066; B65D 5/4287; B65D 5/643; B65D 21/08; B65D 25/102; B65D 63/00; B65D 63/10; B65D 88/1637; B65D 2563/00; B65D 2563/10; B65D 2571/0082; A45C 7/00; A45C 2007/0004; A45C 2007/0013; A45F 2200/0591; F42B 39/02; F42B 39/00; F42B 39/26; F42B 39/085
USPC ..... 206/3, 218, 464, 495, 451, 442, 465; 383/2; 220/7
See application file for complete search history.

(56) References Cited

U.S. PATENT DOCUMENTS

| | | | | |
|---|---|---|---|---|
| 6,595,562 | B1 * | 7/2003 | Wood | B65D 33/004 292/307 A |
| 6,634,131 | B1 | 10/2003 | Fitzpatrick | |
| 7,918,371 | B2 | 4/2011 | Wilson | |
| 8,231,038 | B2 | 7/2012 | Felts | |
| 8,485,405 | B2 | 7/2013 | Crye | |
| 8,733,606 | B2 | 5/2014 | Felts | |
| 8,793,914 | B2 | 8/2014 | Anderson et al. | |

(Continued)

FOREIGN PATENT DOCUMENTS

WO 2021141566 A1 7/2021

OTHER PUBLICATIONS

"KRYDEX 5.56mm 7.62mm Mag Pouch Softshell Magazine Pouch with Molle Clip", Amazon, Accessed on Oct. 15, 2020, accessed at: https://www.amazon.com/KRYDEX-Magazine-Tactical-Softshell-Carrie, 9 pages.

*Primary Examiner* — Robert Poon
(74) *Attorney, Agent, or Firm* — NK Patent Law

(57) ABSTRACT

A carrier device includes: a first panel having hooks, and an inward side, the inward side facing an interior of the carrier device; a second panel having an inward side, the inward side facing the interior of the carrier device opposite the inward side of the first panel; and a binding member for releasably connecting the hooks of the first panel to the second panel. The first panel includes an exterior surface opposite the inward side thereof. All portions of the hooks are flush or sunken relative to the exterior surface of the first panel. The binding member draws lateral edges of the first panel toward lateral edges of the second panel to maintain frictional engagement of an inserted magazine or other article with interior contact points of the carrier device. The panels may include mounting holes for mounting the carrier on another device or structure.

16 Claims, 10 Drawing Sheets

(56) References Cited

U.S. PATENT DOCUMENTS

| | | | | |
|---|---|---|---|---|
| 9,394,080 | B2 | 7/2016 | Beck | |
| D772,368 | S | 11/2016 | Evans | |
| 9,668,568 | B2 | 6/2017 | Evans | |
| 9,759,536 | B2 | 9/2017 | Gadams et al. | |
| 9,795,210 | B2 | 10/2017 | Evans | |
| 10,306,973 | B2 | 6/2019 | Evans et al. | |
| 10,537,167 | B2 | 1/2020 | Bryant et al. | |
| 10,571,220 | B2 | 2/2020 | Toschi | |
| 10,612,888 | B2 | 4/2020 | Toschi | |
| 10,775,133 | B2 | 9/2020 | Higdon, Jr. | |
| 10,928,172 | B1 | 2/2021 | Mironski | |
| 10,962,318 | B2 | 3/2021 | LeMarbe et al. | |
| 11,033,095 | B1 * | 6/2021 | VanHeusen | A45F 5/00 |
| 2005/0056643 | A1 | 3/2005 | Hagan et al. | |
| 2007/0017947 | A1 | 1/2007 | Fenton et al. | |
| 2007/0228099 | A1 | 10/2007 | Beda | |
| 2011/0006090 | A1 | 1/2011 | Bollard | |
| 2013/0082080 | A1 | 4/2013 | Hellweg | |
| 2013/0248566 | A1 | 9/2013 | Solomon | |
| 2016/0003598 | A1 * | 1/2016 | Gadams | B65D 25/04<br>224/191 |
| 2016/0058127 | A1 * | 3/2016 | Burns | A45F 5/02<br>36/58.5 |
| 2017/0099934 | A1 * | 4/2017 | Evans | A45F 5/021 |
| 2019/0365064 | A1 | 12/2019 | Buerck | |

* cited by examiner

ADJUSTABLE CARRIER DEVICE

TECHNICAL FIELD

The present disclosure relates to devices for carrying articles. More particularly, the present disclosure relates to an adjustable carrier device for an ammunition magazine.

BACKGROUND

Ammunition magazine carrying pouches are typically fabric walled and can thus be used to carry various types of articles by conforming somewhat to any inserted article. While such flexibility is useful, in order to secure a carried article, some sort of manually released closure means is needed. For example, a closure flap may overlay the opening of the pouch to secure an enclosed article, with the flap being secured in a closed configuration with a button or hook-and-loop fabric patches. A soft-walled pouch surrounded by a cinching cord may collapse when emptied, and may gather at its opening. Thus typical ammunition carrying pouches may delay access to ammunition or other carried article at a critical moment.

Hard-shell carriers, on the other hand, are typically less flexible as to their use, and may be sized and shaped for a specific article type. While a hard-shell carrier having fixed dimensions such as a box may not collapse when empty, a manually released closure means may be needed as with a soft-walled pouch. Thus, again, access to a needed article such as an ammunition magazine may be delayed at a critical moment as the closure is manually released.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

In at least one embodiment, a carrier device includes: a first panel having hooks, and an inward side, the inward side facing an interior of the carrier device; a second panel having an inward side, the inward side facing the interior of the carrier device opposite the inward side of the first panel; and a binding member for releasably connecting the hooks of the first panel to the second panel.

Each hook of the first panel may include an inwardly extending tooth for retaining a portion of the binding member.

Each hook of the first panel may be defined by a respective slot formed through the first panel.

Each hook of the first panel may include a base connected to a lateral edge of the first panel and an end opposite the base.

Each hook of the first panel may taper trapezoidally from the base thereof to the end thereof.

The first panel may include an exterior surface opposite the inward side thereof, and each hook of the first panel may include an end that is sunken relative to the exterior surface.

Each hook may include an angled face by which the end is sunken, and a base opposite the end; and the hook, from the base thereof to a verge of the angled face thereof, may be flush with the exterior surface.

The first panel may include an exterior surface opposite the inward side thereof, and each said hook of the first panel may include an end that is sunken relative to the exterior surface.

The carrier device may have an open first end for receiving an article to be carried, and a closed second end opposite the first end. A terminal end of the first panel and a terminal end of the second panel may together define an opening at the first end of the carrier device.

A ramped inward contact surface at the terminal end of the first panel and a ramped inward contact surface at the terminal end of the second panel may together define the opening at the first end of the carrier device as a tapered opening.

The first panel and the second panel may be connected at the second end of the carrier device by a base section that defines the second end of the body member.

The first panel, the second panel, and the base section may be portions of a contiguous body member.

A bracket may be nested with the body member, the bracket may include two opposing lateral side members connected by a base plate proximal the base section of the body member.

Each side member may include a respective terminal end opposite the base plate, and wherein the terminal ends of the side members, in cooperation with the terminal ends of the first panel and second panel, define the first end of the assembled carrier device.

Each side member may include a pair of parallel spaced ribs extending longitudinally from proximal the base plate toward the terminal end thereof.

The ribs may have alternating high portions and low portions to guide the binding member.

The binding member may include a stretchable cord having an adjustable loop portion and an adjuster.

The binding member may urge lateral edges of the first panel toward lateral edges of the second panel.

The second panel may include hooks for releasable connection to the hooks of the first panel by the binding member.

In at least one example: the first panel includes an exterior surface opposite the inward side thereof; all portions of the hooks of the first panel are flush or sunken relative to the exterior surface of the first panel; the second panel includes an exterior surface opposite the inward side thereof; and all portions of the hooks of the second panel are flush or sunken relative to the exterior surface of the second panel.

At least one of the first panel and second panel may include mounting holes for receiving fasteners.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
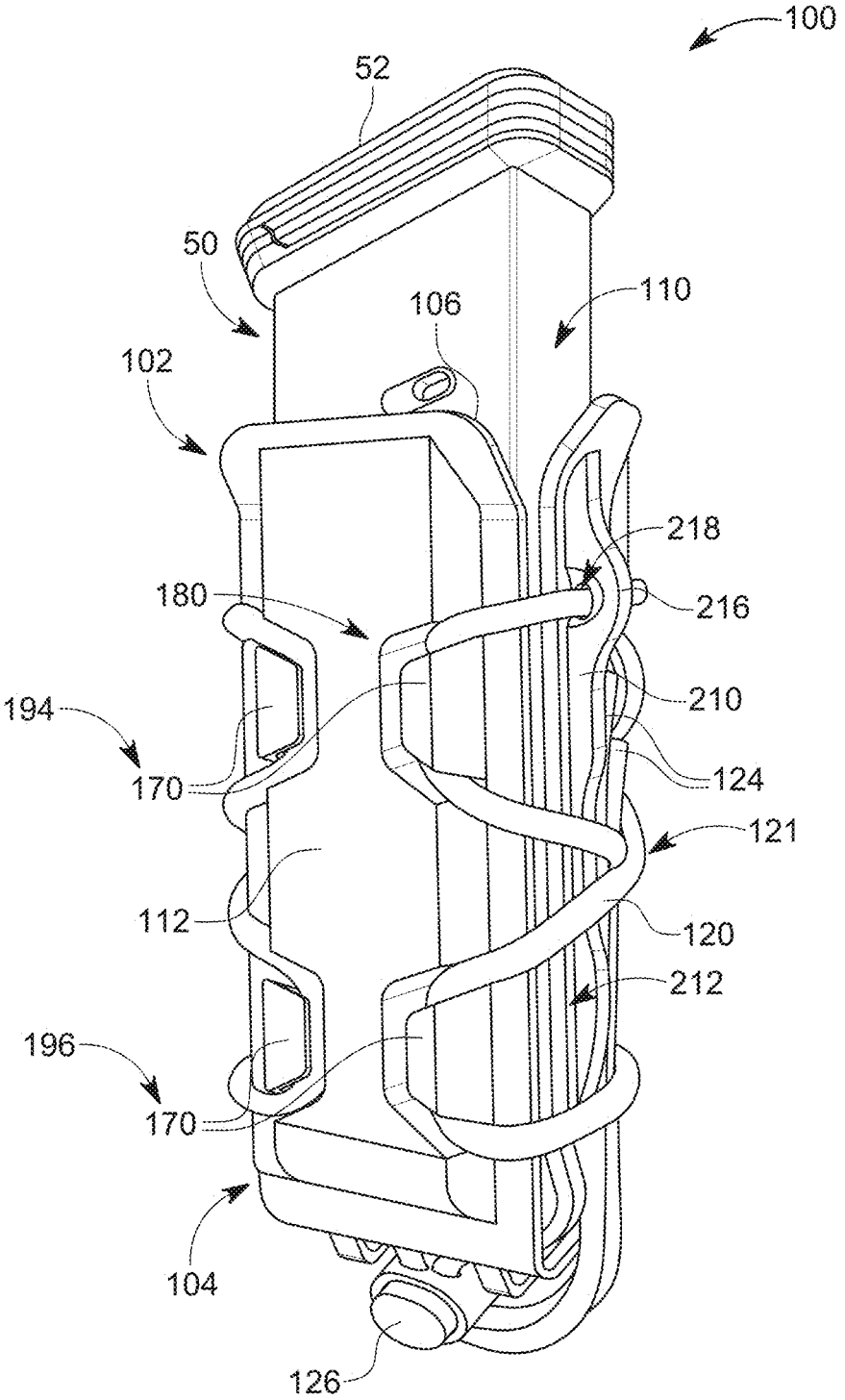
FIG. 1 is a perspective view of a carrier device, according to at least one embodiment, shown carrying a magazine.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

A carrier device 100 according to at least one embodiment is shown in FIG. 1 with an ammunition magazine 50 inserted and retained by the device. Magazines are available in a variety of sizes and configurations for many types of ammunition and firearms. The carrier device 100 accordingly can vary in particular dimensions. The magazine 50 particularly shown in FIG. 1 is for ammunition typically used in a semiautomatic handgun, and thus the carrier device 100 of FIG. 1 can be described as suited for use with a pistol without limitation as to other uses.

In use as shown in FIG. 1, a magazine 50 is inserted into an open first end 102 of the device 100. The open first end 102 may be for example oriented as upward in use. However, due to the magazine retention capability of the device, users may prefer various carrying strategies in which other orientations are utilized. A second end 104 of the device, opposite the first end, is generally closed with regard to insertion or passage of the magazine 50 or other carried articles, such that full insertion of a magazine is registered when the ammunition-feed end of the magazine reaches the of the second end 104 of the device 100. At full insertion, the floor plate end 52 of the magazine extends outward from the first end 102 as available to be grasped and pulled from the carrier device 100. Advantageously ramped inward contact surfaces 106 define a tapered opening 110 into the interior of the carrier device 100, to receive the magazine 50 or other article, and that narrows to guide the magazine or article to proper alignment and insertion.

A first exterior surface 112 (FIG. 1) of the carrier device 100 may be generally directed outward when the carrier device is mounted on a host such as a belt, strap, vest, harness, or pack, such as a MOLLE-equipped host item or apparel, referring to Modular Lightweight Load-carrying Equipment (MOLLE) having spaced mounting straps. In such use, a second exterior surface 114 (FIG. 2), opposite the first exterior surface 112, would be generally directed toward such a host. A mounting strap, for example attached to the second exterior surface 114, may be provided as an accessory for attaching the carrier device 100 to a host.

Retention of the magazine 50 by the carrier device 100 against unintended removal, for example as a user or gear on which the device is mounted moves about, is assured by the elastically self-adjusting performance of the carrier device. A binding member 120 is stretched among front, side, and back panels of the device 100 thereby adjustably circumferentially tightening the device around the magazine to maintain frictional engagement of an inserted magazine with interior contact points of the carrier device. This frictionally secures an inserted magazine while permitting sliding entry and removal of the magazine by force applied by hand at the outward extending end of the magazine, such as the floor plate end 52 of the magazine.

Figure 10:
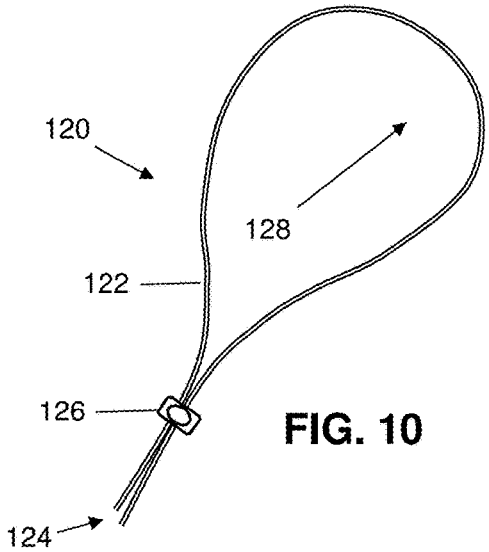
FIG. 10 shows a binding member and adjuster thereof separated from the device of FIG. 1.
Figure 11:
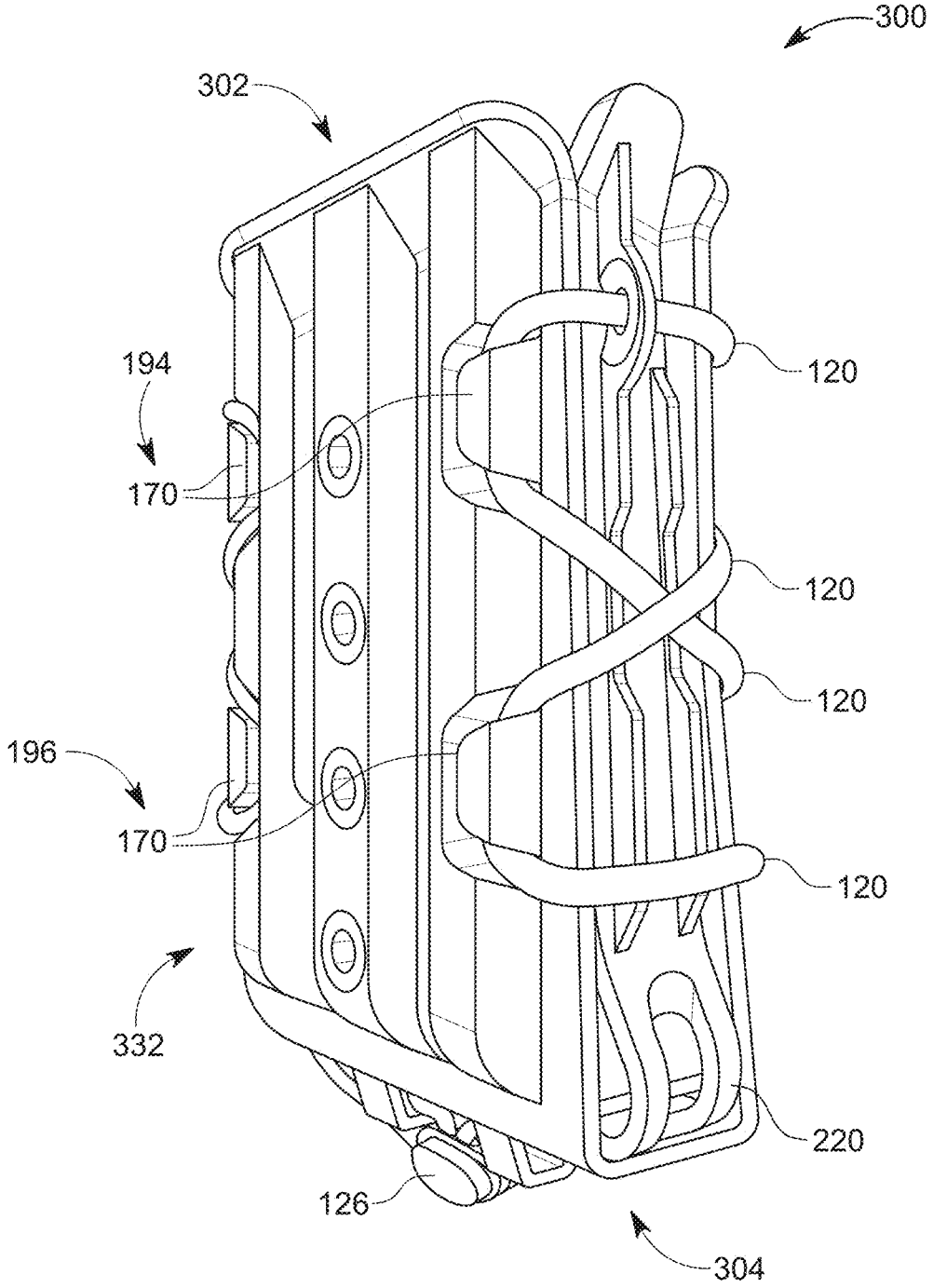
FIG. 11 shows the front of a carrier device, according to at least one other embodiment, in perspective view.

The binding member 120 is illustrated as a stretchable cord 122 having one or more elastic strands forming a core covered in a woven fibrous sheath, for example made of polypropylene. Such binding members are known, for example, as shock cords and bungee cords. Opposite free ends 124 of the binding member extend from an adjuster 126 to define an adjustable loop portion 128 (FIG. 10) of the binding member. The adjuster 126 is shown as a cord lock in the drawings. The adjustable loop portion 128 of the binding member 120 urges the interior of carrier device 100 upon a magazine or other carried article to maintain frictional engagement.

The first exterior surface 112 and opposite second exterior surface 114 of the carrier device 100 in the illustrated embodiment are defined by the outer surfaces of corresponding sections of a single materially contiguous body member 130 (FIG. 4) when folded as in the assembled device 100 (FIG. 1). A first section of the body member 130 defines a front or first panel 132 of the assembled carrier device 100, and a second section of the body member 130 defines a back or second panel 134 of the assembled carrier device 100. Front and back are nominal terms referring to some expected uses of the carrier device 100 without limiting the carrier device 100 in its construction or use.

Figure 5:
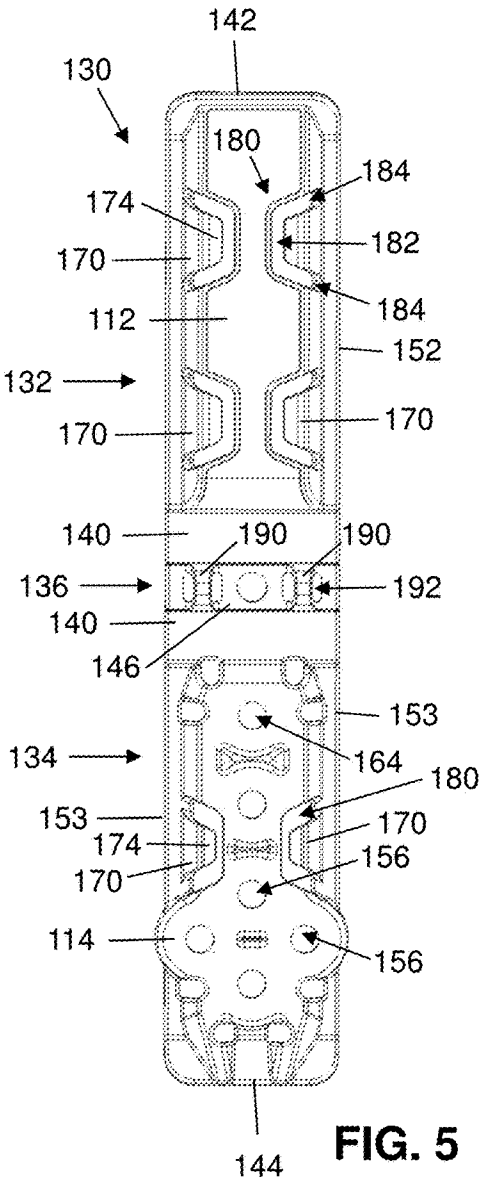
FIG. 5 shows the outward side of the body member of FIG. 4 in plan view.
Figure 4:
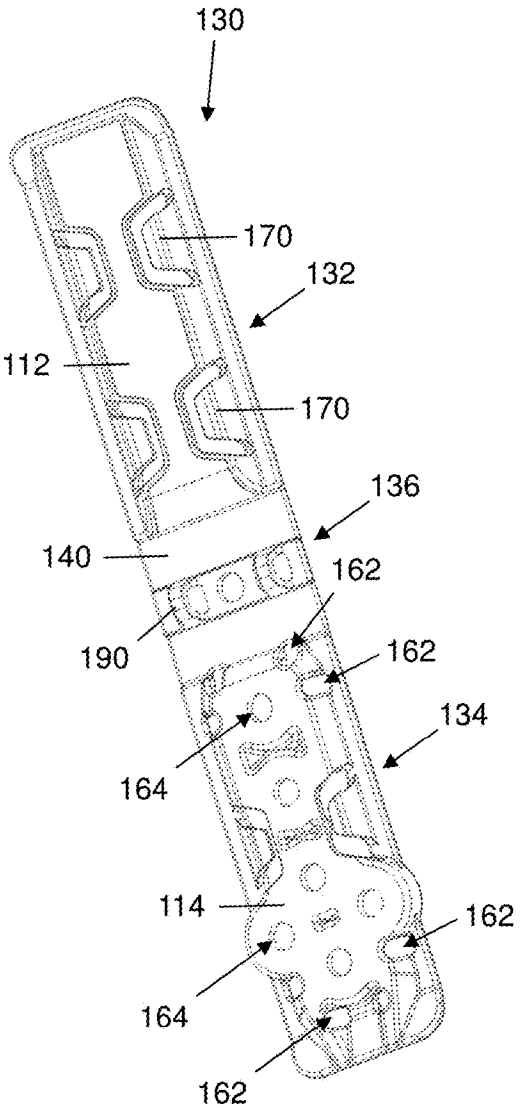
FIG. 4 shows the outward side of an unfolded body member of the device of FIG. 1 in perspective view.

The first panel 132 and second panel 134 are each attached to a base section 136 (FIG. 5) of the body member 130. The first panel 132 extends from a flexible first strip portion 140 of the base section 136 to a first terminal end 142 of the body member 130. The second panel 134 extends from a flexible second strip portion 140 of the base section 136 to a second terminal end 144 of the body member 130. The terminal ends 142,144 extend in opposite directions from the base section 136 in the unfolded condition (FIG. 4). When the first panel 132 and second panel 134 are folded into approximately parallel condition as in the assembled carrier device 100 (FIG. 1), the terminal ends 142,144 extend in a common direction and define, in cooperation with the bracket 200 as described below, the first end 102 of the device. The folding of the body member 130 is effected as flexure, at least or particularly, of the flexible strip portions 140, which are connected by a rigidified base plate 146 (FIG. 4) that defines the second end 104 of the assembled carrier device 100 (FIG. 1).

Figure 6A:
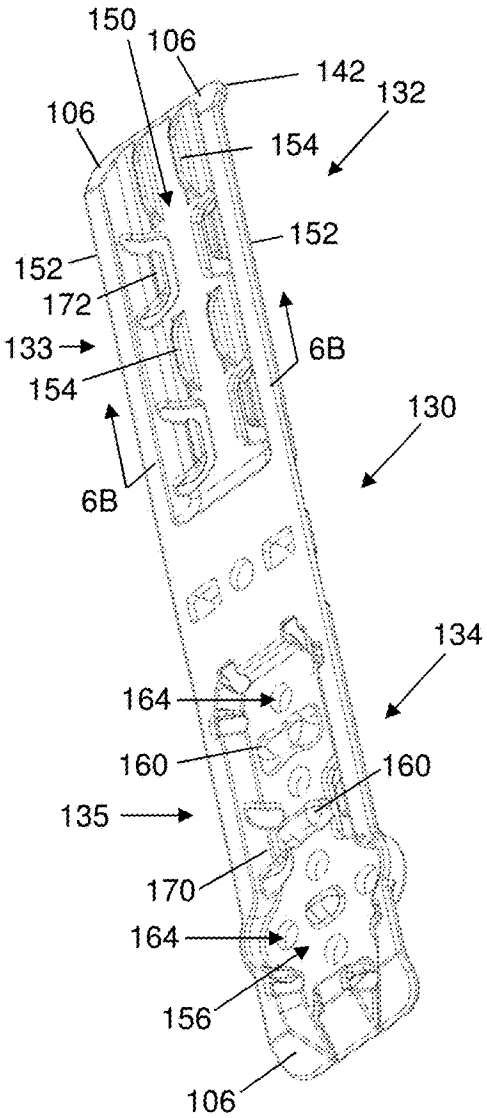
FIG. 6A shows the inward side of the body member of FIG. 4 in perspective view.
Figure 6B:
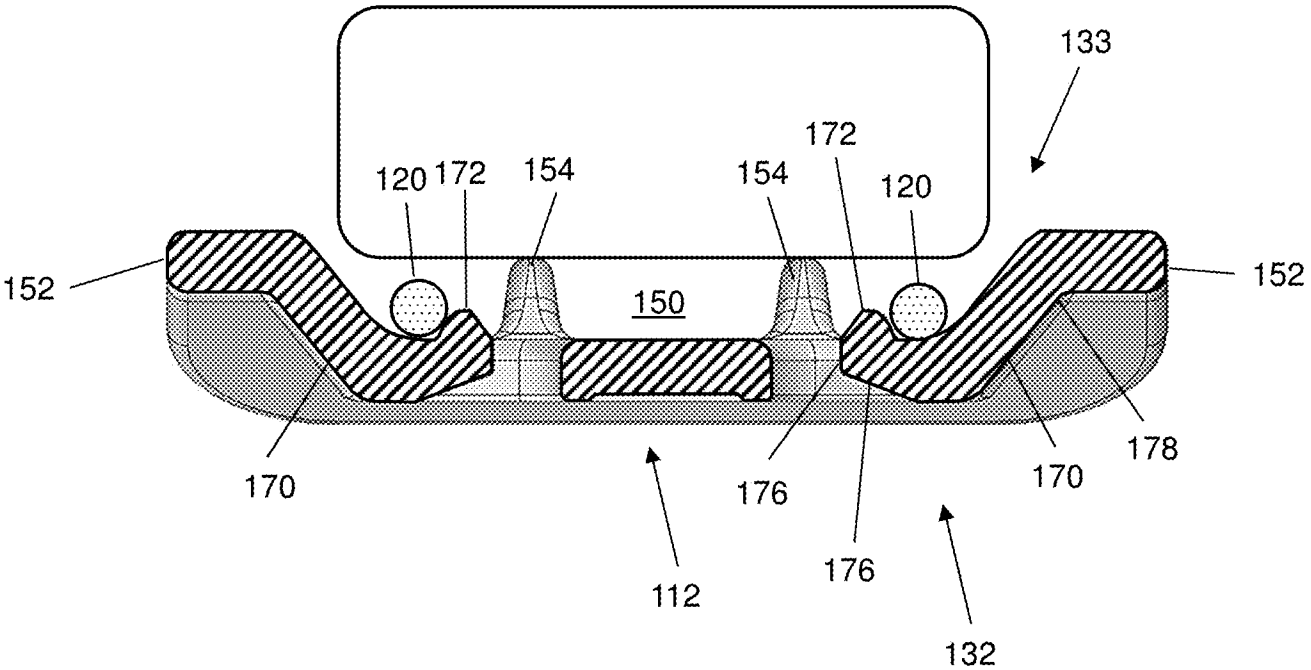
FIG. 6B is a cross-sectional view of the body member taken along the line 6B-6B in FIG. 6A

Contours and operative features of the body member 130 rigidify the first panel 132, second panel 134, and base plate 146. For example, with reference to rigidifying contours of the body member 130, the inward side 133 of the first panel 132 has an inside channel 150 (FIG. 6A), extending longitudinally from the first terminal end 142 to the first strip portion 140 of the base section 136, defined between lateral edges 152 of the first panel 132. Longitudinal ridges 154 extend inward in laterally spaced pairs from the inward side 133 of the first panel 132 further add rigidity and provide frictional engagement with a magazine 50 or other article within the carrier as represented in FIG. 6B.

The inward side 135 (FIG. 6A) of the second panel 134, which faces the inward side 133 of the first panel 132 in the assembled carrier device, has an inside recess 156 defined between its lateral edges 153, and several inward extending bosses 160 to provide further frictional engagement with a magazine or other article on an opposite side of the article relative to the ridges of the first panel 132. Multiple holes 162 (FIG. 4) for passage and retention of the binding member 120 (FIG. 2) are defined through the second panel 134 along the periphery of the recess 156. Mounting holes 164 for receiving fasteners such as screws are defined through outwardly planar portions of the second panel 134 opposite the recess 156. The arrangement pattern of the holes 164 matches hole patterns in accessories such as the mounting strap 56 attached to the second panel 134 in FIG. 3 by fasteners 58.

Along each lateral edge 152, the first panel 132 has laterally inwardly directed hooks 170 defined by slots 180 formed through the first panel. Each hook 170, at an end 176 thereof, has an inwardly extending tooth 172 (FIG. 6B) that retains a portion of the binding member 120 in the assembled carrier device 100. An angled face 174 of the hook 170, at the end 176 and opposite the tooth 172, is angled inward away from the first exterior surface 112. The end 176 of the hook 170 is thereby sunken relative to the first exterior surface 112 to protect the end of the hook from snagging on other objects. The angled face 174 is particularly advantageous in that, even if tension in the binding member 120 flexes the hook somewhat, the angled face 174 assures the end 176 of the hook remains sunken, approaches a flush disposition with the first exterior surface 112, or is minimally exposed to any likelihood of snagging other objects. Each slot 180 is approximately U-shaped, having a longitudinally extending linear central slot portion 182 (FIG. 5), and a respective angled slot portion 184 at each end of the central slot portion, thereby defining an approximately trapezoidal hook 170 that has a base 178 (FIG. 6B) connected to a corresponding lateral edge 152 and tapers therefrom to the end 176 of the hook. The hook 170, from the base 178 to the verge of the angled face 174 is flush with the contours of the first exterior surface 112.

Along each lateral edge 153 thereof, the second panel 134 has a respective laterally inwardly directed hook 170 defined by slots 180 similarly as for the hooks 170 of the first panel 132. Each hook 170 of the second panel 134, however, in the illustrated embodiment does not have a tooth. The hook 170 retains a portion of the binding member 120 in the assembled carrier device 100, and an angled face 174 of the hook opposite the tooth by which the end 176 of the hook is thereby sunken relative to the second exterior surface 114. Each hook 170 is approximately trapezoidal, having a base 178 connected to a corresponding lateral edge 153 and tapering trapezoidally therefrom to the end 176 of the hook 170.

Figure 2:
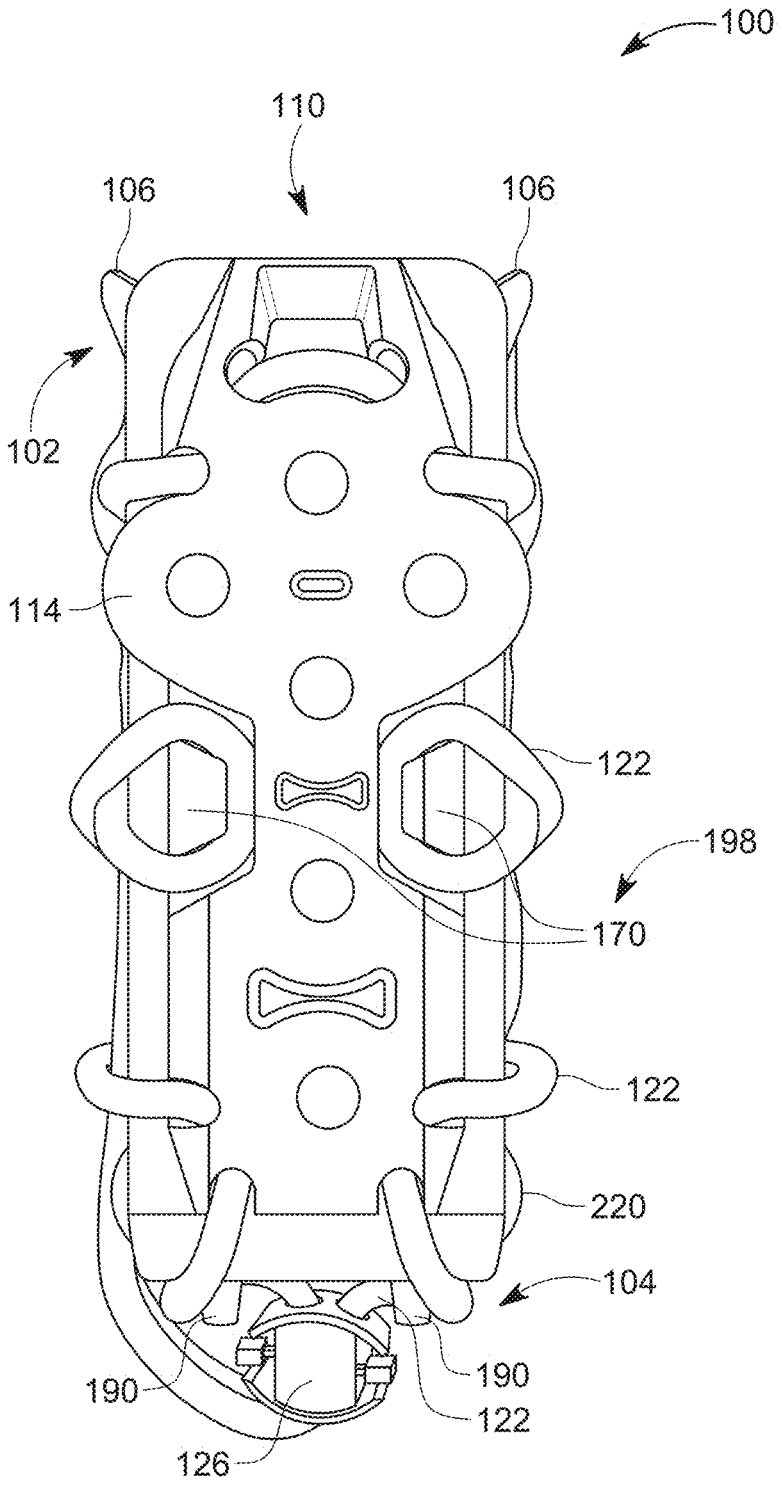
FIG. 2 is a back view of the device of FIG. 1, without a magazine.

A laterally spaced pair of tabs 190 extend outward from the outward side of the base section 136 of the body member 130. Each tab 190 has a laterally extending hole 192 for passage and retention of the binding member 120, for example as shown in FIG. 2. In the binding arrangement of the drawings, the adjuster 126 is nestled between the tabs when the binding member 120 is drawn taut.

In the illustrated embodiments, the first panel 132 has an opposing first pair 194 of hooks proximal the first end 102 (FIG. 1) and an opposing second pair 196 of hooks 170 proximal the second end 104 longitudinally spaced from the first pair 194. The second panel 134 has an opposing pair of hooks 170, referenced as the third pair 198 (FIG. 2) rearwardly offset from, and longitudinally positioned between, the first pair 194 and second pair 196 in the assembled carrier device 100. By such placement of the pairs, the binding member 120 can be engaged in ordered succession such as the first pair 194, the third pair 198, and the second pair 196 along each lateral side of the carrier device 100 as in the illustrated binding arrangement.

Figure 7:
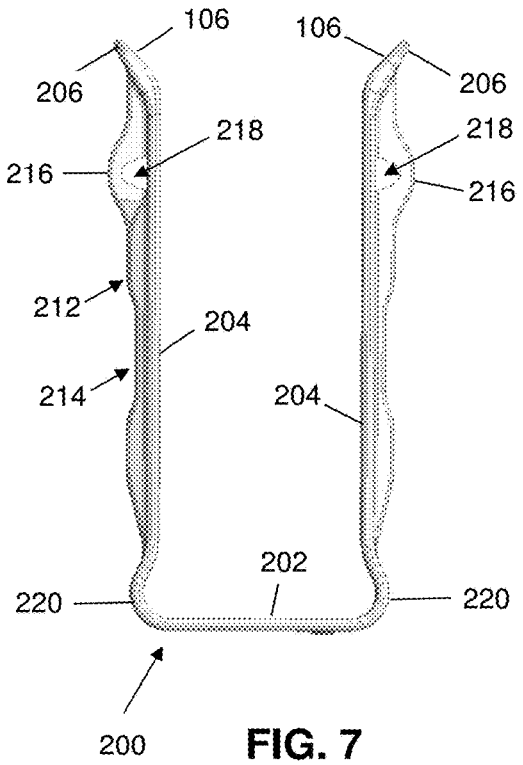
FIG. 7 shows a bracket of the device of FIG. 1.
Figure 8:
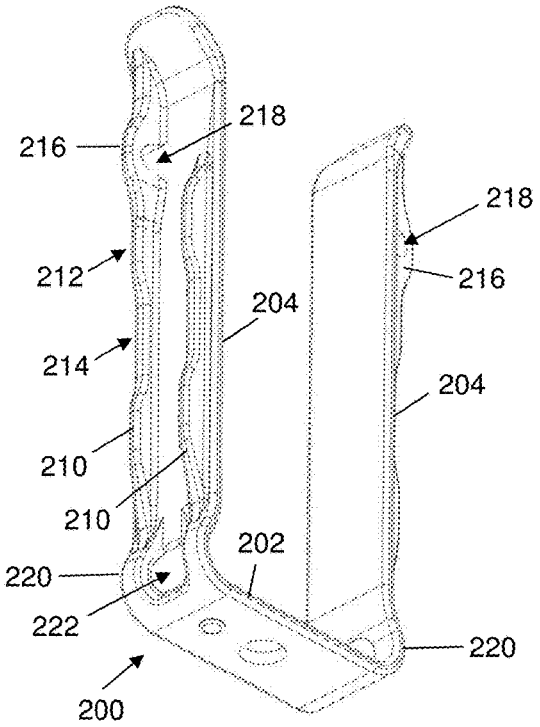
FIG. 8 shows the bracket of FIG. 7 in perspective view.
Figure 9:
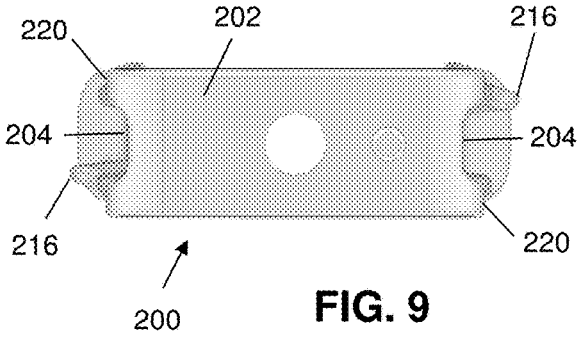
FIG. 9 shows the bottom of the bracket of FIG. 7.

Opposite lateral side members of the assembled carrier device 100 (FIGS. 1,2) are provided by the bracket 200 shown in various views in FIGS. 7-9. The bracket 200 includes a central base plate 202 (FIG. 7) and, attached to opposite respective lateral ends of the base plate, a first lateral side member 204 and a second lateral side member 204 that extend in a same direction from the base plate. In the assembled carrier device 100, the bracket 200 is nested within the body member 130 in the folded condition, with the exterior side of the base plate 202 of the bracket 200 abutting or proximate the interior side of the base plate 146 of the body member 130.

Respective terminal ends 206 of the side members 204, in cooperation with the terminal ends 142 and 144 of the body member 130, define the first end 102 of the assembled carrier device 100. Accordingly, a respective ramped inward contact surface 106 that cooperates with the others to define the tapered opening 110 is provided, at each inward side, at the terminal end 142 of the first panel 132, at the terminal end 144 of the second panel 134, and at each of the terminal ends 206 of the side members 204.

Each lateral side member 204 has a pair of parallel spaced ribs 210 (FIG. 8) extending longitudinally from proximal the base plate toward the terminal end thereof. The ribs 210 rigidify the side members and provide guiding and retention of the binding member 120. The ribs 210 have alternating high portions 212 and low portions 214 to guide and stabilize the binding member 120 in a binding arrangement with portions of the binding member received in the low portions. Particularly in the binding arrangement of the drawings, the free ends 124 of the binding member 120 extending from the adjuster 126 are conveniently held in a space, which extends between the ribs, under crossed portions of the adjustable loop portion of the binding member. At least one rib 210 of each side member has a highest portion 216 (FIG. 7-8) through which a hole 218 is defined for passage and retention of the binding member 120, for example as shown in FIG. 1. The highest portions 216 on opposing side members are offset with respect to front and back of the assembled carrier device 100, such that the two side members 204 are thereby asymmetric across the central base 202, to facilitate proximity of two side-by-side carrier devices 100, for example closely mounted on a MOLLE-equipped host item or apparel.

Figure 3:
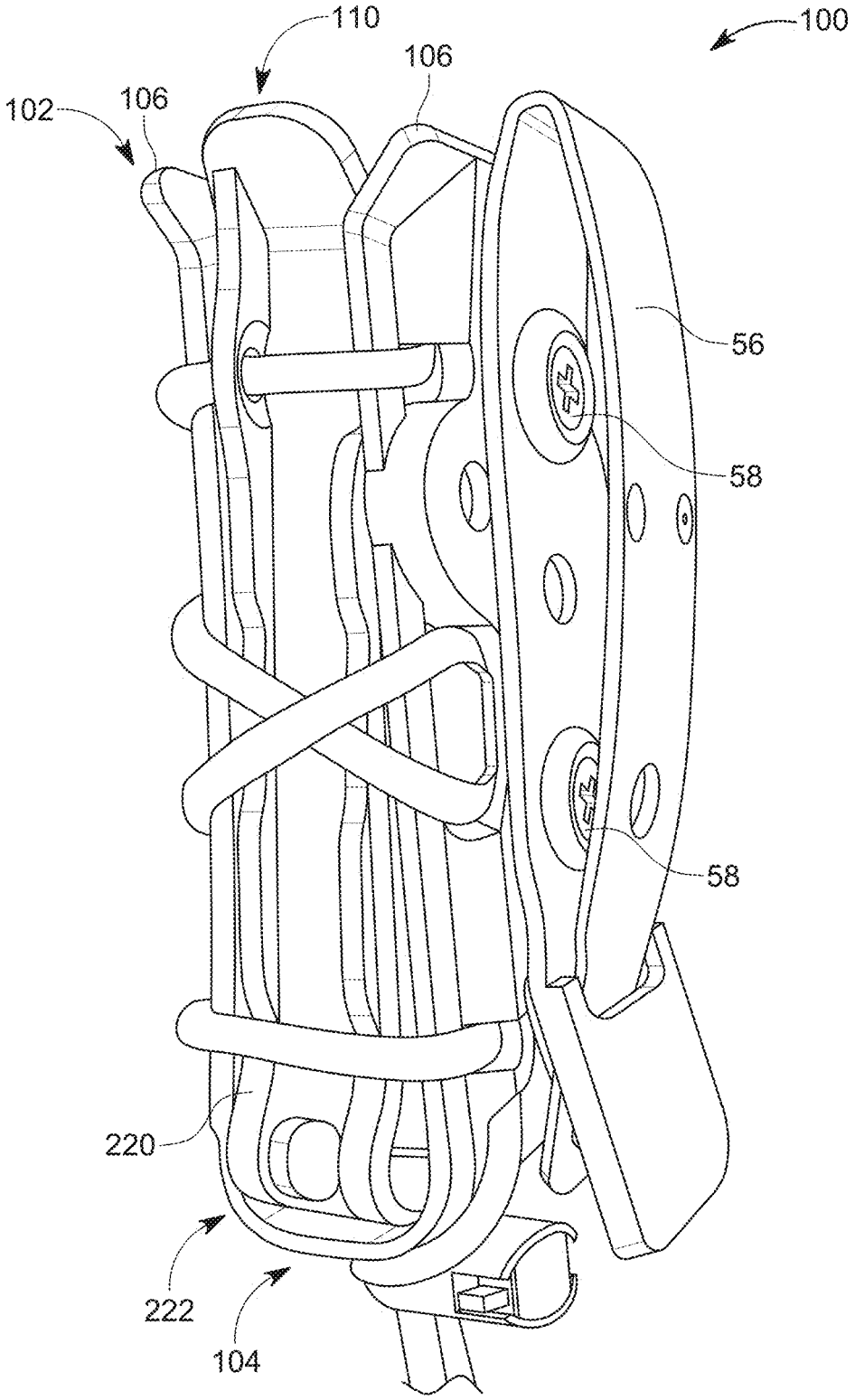
FIG. 3 is a perspective view of the device of FIG. 1, without a magazine, shown with a mounting strap attached to the back thereof.

Each lateral side member 204, at its junction with the central base 202, has an arcuate laterally outwardly extending shoulder 220 in which a notch 222 is defined. The shoulders 220, in cooperation with proximal low portions of the ribs, guide and stabilize the binding member 120 in a binding arrangement, for example as shown in FIGS. 1 and 3. Either notch 222 can further guide and stabilize the binding member 120 by receiving portions of the free ends 124 proximate the adjuster 126 according to which side of bracket 200 the free ends are placed between ribs 210 and under crossed portions of the binder member 120 as exemplified in FIG. 1.

In the binding arrangement of the drawings, the binding member 120 is retained by its passage through holes 163 in the second panel 134 and base plate, and engages the hooks in both the first panel 132 and second panel 134. Advantageously, the engagement of the binding member 120 with the first panel 132 is by way of the first and second hooks without passing through any hole in the first panel 132. By this advantageous feature, the first panel 132 can be disengaged from the binding member 120 without necessitating delacing of the carrier device overall. Such disengagement can, for example, permit opening of the carrier device by hinging the first panel 132 relative to the second panel 134 by flexure of the strip portions 140 of the base section 136 as a living hinge. By such disengagement, the carrier device 100 can be effectively opened for inspection, clearing, or cleaning. Re-engagement can be achieved by re-hooking the binding member 120 in any preferred binding arrangement. In the illustrated binding arrangement, a twist is introduced in the binding member 120 when engaging the third hooks to effect the crossed portions 121 illustrated (FIG. 1). Low portions of the ribs in each of side members are positioned longitudinally in alignment with the third hooks to receive such crossed portions 121 conveniently.

Even where adjustment of the carrier device 100 is wanted without opening, use of the hooks 170, instead of holes, permit considerable convenience and ease in adjusting the binding member 120, avoids kinks, and facilitates tension uniformity along the serpentine path of the loop portion of the binding member 120 in any binding arrangement that utilizes the hooks. The hooks further serve to avoid full winding of the binding member 120 around the first panel 132 and second panel 134. The binding member 120 in the illustrated binding engagement with the hooks is sunken within the slots 180 and under the hooks 170 relative to the first exterior surface 112 and second exterior surface 114. This protects the binding member 120 from snagging, direct collision, or crushing along the first exterior surface 112 and second exterior surface 114, which are expected to be the front and back of the carrier device 100 in typical use and thus are expected to see the highest likelihood of contact and striking with other objects. The binding member 120, when taut, urges the lateral edges 152 of the first panel 132 toward the lateral edges 153 of the second panel 134 to maintain frictional engagement of the inward sides 133 and 135 with an inserted magazine or other carried article.

Retention of an inserted magazine 50 or other article, such as a tactical light, a knife, or other gear item is assured against unintended removal by the frictional engagement provided to the interior of the carrier device 100 by the taut binding member 120 that urges the edges of the first panel 132 and second panel 134 together. The semirigid panels and side members 204 of the bracket 200, cooperatively acting with the binding member 120 as a self-adjusting frame, prevent closure of the opening 110 to maintain access to the interior of the carrier device 100 and assure the carrier device, when empty, is ready to rapidly receive an article such as a magazine. This is beneficial over, for example, a soft-walled pouch surrounded by a cinching cord, which may collapse when emptied, and may gather at its opening to delay withdrawal of an enclosed magazine at a critical moment.

Figure 12:
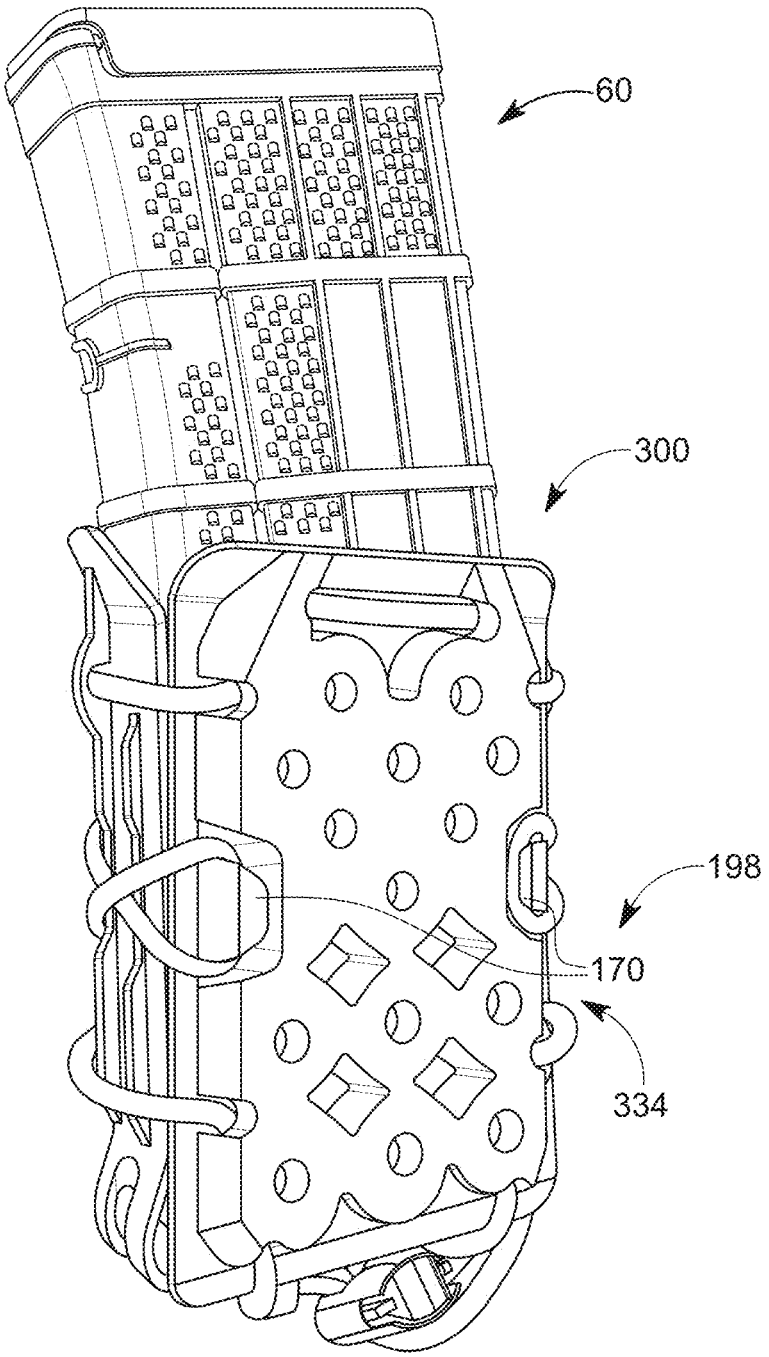
FIG. 12 shows the back of the carrier device of FIG. 11, shown carrying a magazine, in perspective view.
Figure 13:
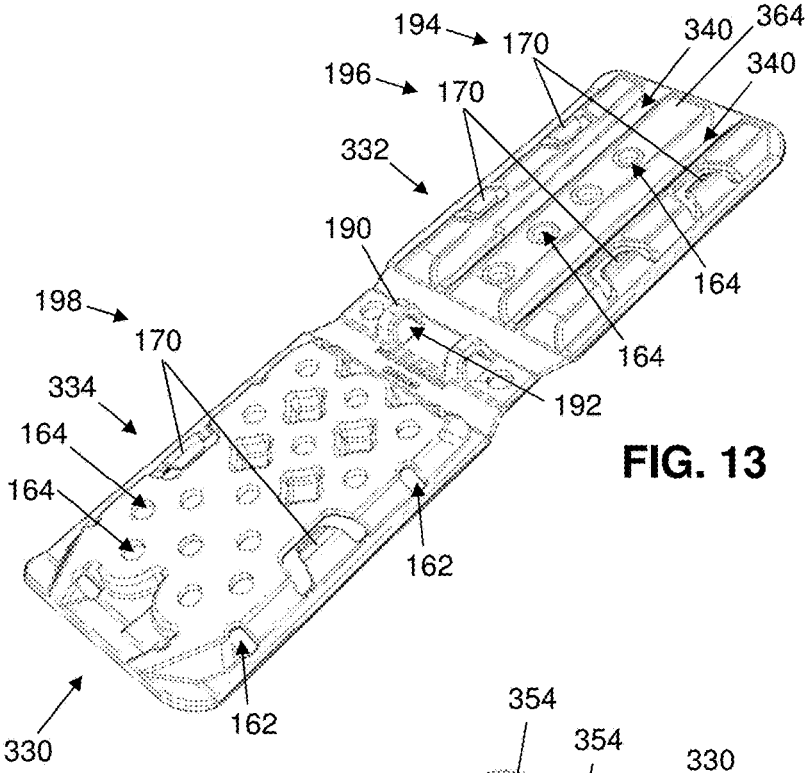
FIG. 13 shows the outward side of an unfolded body member of the device of FIG. 11 in perspective view.
Figure 14:
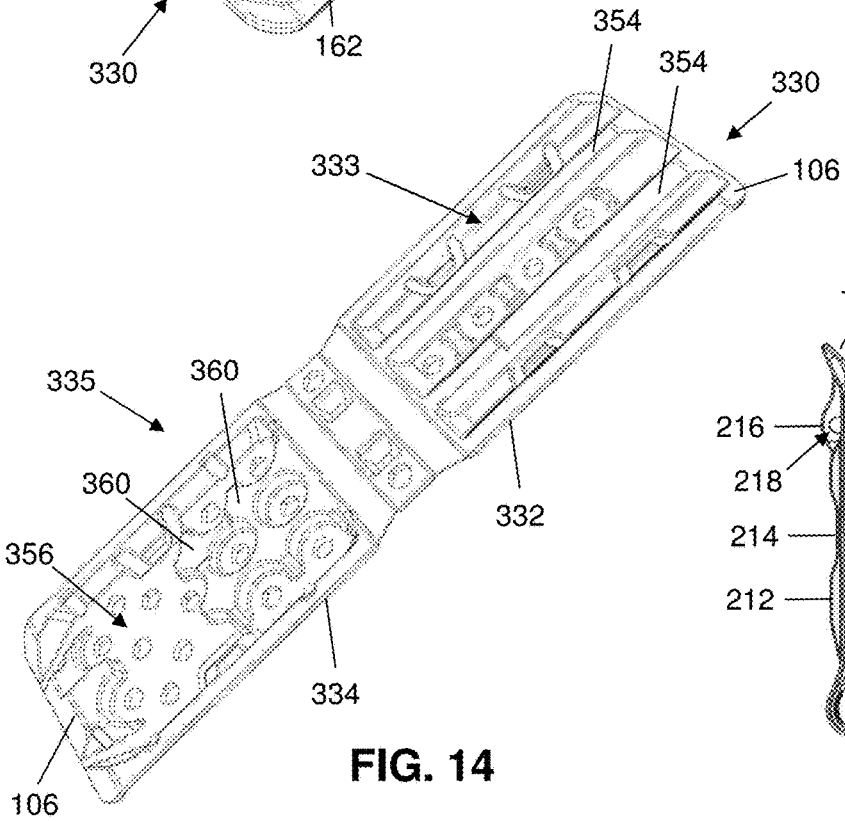
FIG. 14 shows the inward side of the body member of FIG. 11 in perspective view.
Figure 15:
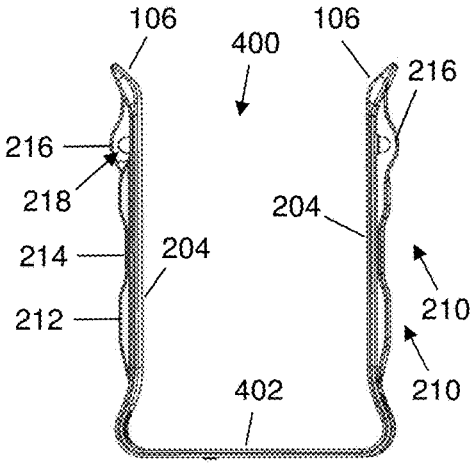
FIG. 15 shows a bracket of the device of FIG. 11.

The magazine 50 particularly shown in FIG. 1 is for ammunition typically used in a semiautomatic handgun, and thus the carrier device 100 and its components of FIGS. 1-10 can be described as suited for use with a pistol without limitation as to other uses. Similarly, the magazine 60 particularly shown in FIG. 12 is for ammunition typically used in a semiautomatic rifle, and thus the carrier device 300 and its components of FIGS. 11-15 can be described as suited for use with a rifle without limitation as to other uses.

The carrier device 300 of FIGS. 11-15 bears similarities to the carrier device 100 of FIGS. 1-10 such that the above descriptions apply as well where like reference numbers are used. The carrier device 300 of FIGS. 11-15 is laterally wider to accommodate the corresponding width of a magazine loaded with rifle ordinance. The wider second panel 334 of the carrier device 300, relative to the second panel 134 of the carrier device 100, has more area and accordingly more mounting holes 164 through the outwardly planar portion of opposite its recess 356. As in the carrier device 100, the arrangement pattern of the holes 146 in the second panel 334 of the carrier device 300 matches hole patterns in accessories such as the mounting strap 56 attached to the carrier device 100 in FIG. 3.

Figure 16:
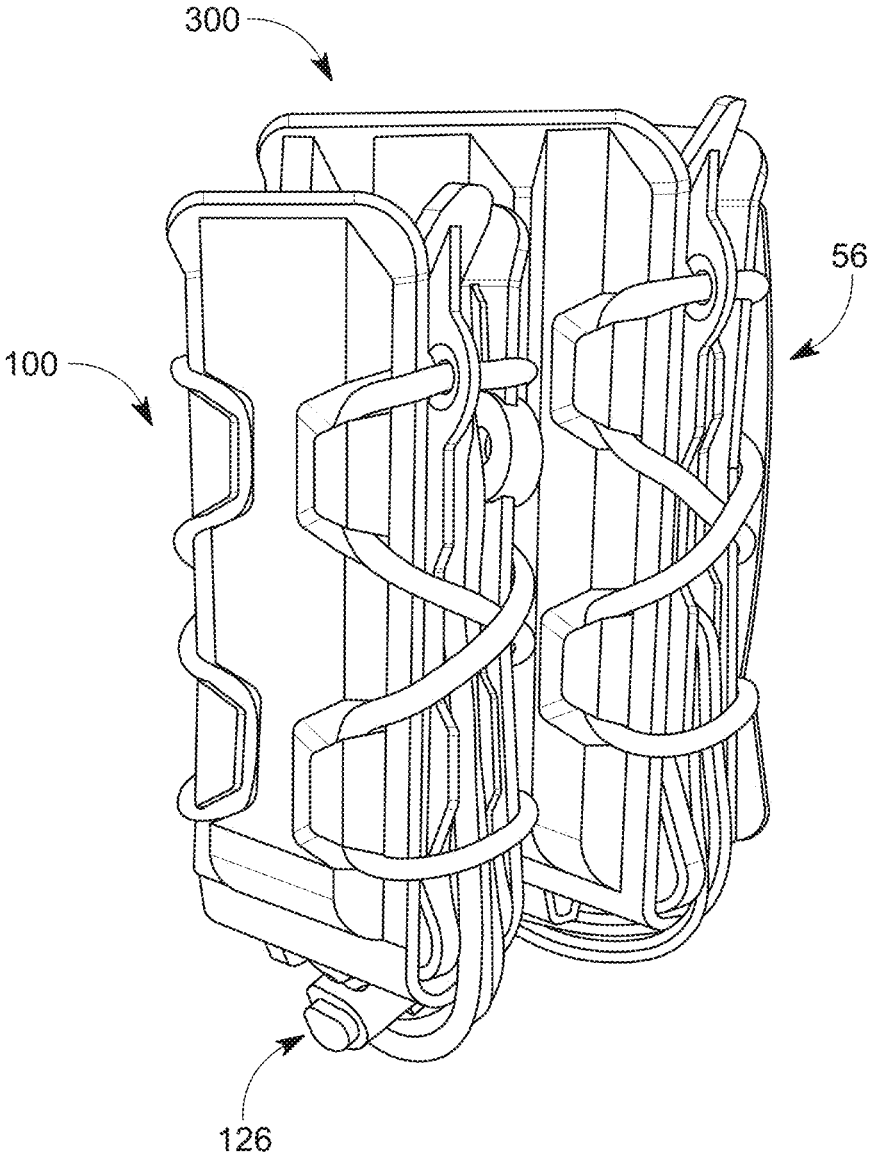
FIG. 16 shows the device of FIG. 1 mounted upon the device of FIG. 11 to define a combination assembly.

The wider body member 330 of the carrier device, relative to the body member 130 of the carrier device 100, accommodates additional rigidifying features. The first panel 332 is further contoured by longitudinally extending inward grooves 340 (two in the illustrated embodiment) along the exterior surface (FIG. 13), such that multiple (three in the illustrated embodiment) outward high portions are defined. A central high portion 364 has mounting holes 164 for attachment of or to other articles, see for example FIG. 16 in which the carrier device 100 is attached to the first panel 332 of the carrier device 300, and a mounting strap 56 is attached to the second panel 334 of the carrier device 300.

Longitudinal ridges 354 extend inward from the inward side 333 of the first panel 332 (FIG. 14) materially opposite and corresponding to the inward grooves 340 along the exterior surface. These further add rigidity and provide frictional engagement with a magazine or other article within the carrier functionally similar to the ridges of the carrier device 100. The inward side 335 (FIG. 14) of the second panel 334 has an inside recess 356 defined between its lateral edges, and several inward extending contact bosses 360 to provide further frictional engagement with a magazine or other article on an opposite side of the article relative to the ridges 354 of the first panel 132.

Descriptions above of the bracket 200 of the carrier device 100 apply as well to the bracket 400 (FIG. 15) of the carrier device 300, as denoted by same reference numbers for same or similar features, differing by dimension or placement but providing same or similar function. The central base plate 402 of the bracket 400 is wider than that of the bracket 200 to accommodate the corresponding width of a magazine 60 loaded with rifle ordinance.

The first panel 332 has an opposing first pair 194 of hooks 170 proximal the first terminal end 302 (FIG. 11) and an opposing second pair 196 of hooks 170 proximal the second end 304 longitudinally spaced from the first pair. The second panel 334 has an opposing pair of hooks 170, referenced in the drawings as the third pair 198 rearwardly offset from, and longitudinally positioned between, the first pair 194 and second pair 196 in the assembled carrier device 300. The hooks 170 of the carrier device 300, in cooperation with the binding member 120, provide the same of similar function as those described above with reference to the carrier device 100 such the above descriptions apply as well to both carrier devices.

With reference to both the carrier device 100, and the carrier device 200, and similar embodiments within the scope of these descriptions and referenced drawings, the body member and bracket thereof can be injection molded of thermoset plastic that, when set, is durable, semirigid, and resilient against flexures.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A carrier device having an open first end, for receiving an article to be carried into an interior of the carrier device, and a closed second end on an opposite side of the interior from the first end, the carrier device comprising:

a body member comprising a first panel comprising hooks disposed on an exterior surface opposite an inward side, the inward side facing the interior of the carrier device, wherein each of the hooks is flush with the exterior surface, a second panel comprising an inward side, the inward side facing the interior of the carrier device opposite the inward side of the first panel, and a base section affixed to connected ends of the first panel and the second panel and disposed opposite the first end of the carrier device;

a bracket comprising opposed lateral side members disposed on opposed sides of the interior, each side member having an inward face adjacent the interior and an opposed exterior face, and a base plate affixed to connected ends of each of the opposed lateral side members and disposed opposite the first end of the carrier device; and a binding member for releasably connecting the hooks of the first panel to the second panel, the binding member having free ends, wherein each lateral side member, along the exterior face thereof, comprises a pair of parallel spaced ribs, each of the ribs extending longitudinally between the connected end and an opposed terminal end along a peripheral edge of a respective one of the lateral side members, and a longitudinally extending channel between and separating the ribs, wherein each of the ribs have alternating high portions and low portions to guide the binding member and the channel is configured to accept the free ends of the binding member and the ribs are configured to guide the binding member such that crossed portions thereof secure the free ends thereof in the channel.

2. The carrier device of claim 1, wherein each of the hooks of the first panel comprises an inwardly extending tooth for retaining a portion of the binding member.

3. The carrier device of claim 1, wherein each of the hooks of the first panel is defined by a respective slot formed through the first panel.

4. The carrier device of claim 1, wherein each of the hooks of the first panel comprises a base connected to a lateral edge of the first panel and an end opposite the base.

5. The carrier device of claim 4, wherein each of the hooks of the first panel tapers trapezoidally from the base thereof to the end thereof.

6. The carrier device of claim 1, wherein each of the hooks of the first panel comprises an end that is sunken relative to the exterior surface.

7. The carrier device of claim 6, wherein each of the hooks comprises an angled face by which the end is sunken, and a base opposite the end.

8. The carrier device of claim 1, wherein, a ramped inward contact surface at the terminal end of the first panel and a ramped inward contact surface at the terminal end of the second panel together define the opening at the first end of the carrier device as a tapered opening.

9. The carrier device of claim 1, wherein the first panel and the second panel are pivotally attached to the base section.

10. The carrier device of claim 1, wherein the base plate is disposed between the base section and the interior of the carrier device.

11. The carrier device of claim 1, wherein the terminal ends of the side members, in cooperation with the terminal ends of the first panel and second panel, define the open first end of the carrier device when assembled.

12. The carrier device of claim 1, wherein the binding member comprises a stretchable cord having an adjustable loop portion and an adjuster.

13. The carrier device of claim 12, wherein the binding member urges lateral edges of the first panel toward lateral edges of the second panel.

14. The carrier device of claim 1, wherein the second panel comprises hooks for releasable connection to the hooks of the first panel by the binding member.

15. The carrier device of claim 14, wherein:

the second panel comprises an exterior surface opposite the inward side thereof; and all portions of the hooks of the second panel are flush or sunken relative to the exterior surface of the second panel.

16. The carrier device of claim 14, wherein both the first panel and second panel comprise mounting holes for receiving fasteners.

* * * * *